US006550322B2

(12) United States Patent
Sweetland et al.

(10) Patent No.: US 6,550,322 B2
(45) Date of Patent: Apr. 22, 2003

(54) HYDRAULIC STRAIN SENSOR

(75) Inventors: Matthew Sweetland, Somerville, MA (US); Merlin D. Hansen, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/091,200

(22) Filed: Mar. 5, 2002

(65) Prior Publication Data

US 2002/0121134 A1 Sep. 5, 2002

Related U.S. Application Data

(63) Continuation of application No. 09/663,372, filed on Sep. 12, 2000, now Pat. No. 6,389,890, which is a continuation of application No. 09/267,498, filed on Mar. 12, 1999, now abandoned.

(51) Int. Cl.[7] ..... E21B 44/00; E21B 47/06

(52) U.S. Cl. ..... 73/152.51; 73/152.48; 73/152.46; 73/152.27; 166/250.01; 166/254.2

(58) Field of Search ..... 73/152.22–152.59, 73/784, 783, 720; 175/40, 48, 50; 166/250.01, 250.07, 250.1, 254.2, 264

(56) References Cited

U.S. PATENT DOCUMENTS

| | | | | | |
|---|---|---|---|---|---|
| 2,681,567 | A | * | 6/1954 | Widess | 73/151 |
| 3,233,674 | A | * | 2/1966 | Leutwyler | 166/63 |
| 3,465,582 | A | * | 9/1969 | Richter, Jr. et al. | 73/152 |
| 3,627,065 | A | * | 12/1971 | Murphy | 175/48 |
| 3,855,853 | A | * | 12/1974 | Claycomb | 73/151 |
| 3,991,610 | A | * | 11/1976 | Rakar et al. | 73/151 |
| 4,157,528 | A | * | 6/1979 | Shuck et al. | 338/42 |
| 4,294,318 | A | * | 10/1981 | Desbrandes et al. | 175/321 |
| 4,524,324 | A | * | 6/1985 | Dickinson, III | 324/323 |
| 4,608,861 | A | * | 9/1986 | Wachtler et al. | 73/151 |
| 4,676,310 | A | * | 6/1987 | Scherbatskoy et al. | 166/65.1 |
| 4,693,335 | A | * | 9/1987 | Almon | 181/102 |
| 4,805,449 | A | * | 2/1989 | Das | 73/151 |
| 4,896,722 | A | * | 1/1990 | Upchurch | 166/250 |
| 5,048,344 | A | * | 9/1991 | Herget et al. | 73/784 |
| 5,050,690 | A | * | 9/1991 | Smith | 175/50 |
| 5,065,619 | A | * | 11/1991 | Myska | 73/152 |
| 5,099,700 | A | * | 3/1992 | Morin et al. | 73/862.04 |
| 5,205,164 | A | * | 4/1993 | Steiger et al. | 73/153 |
| 5,343,963 | A | * | 9/1994 | Bouldin et al. | 175/27 |
| 5,499,533 | A | * | 3/1996 | Miller et al. | 73/152 |
| 5,517,854 | A | * | 5/1996 | Plumb et al. | 73/151 |
| 5,582,064 | A | * | 12/1996 | Kluth | 73/4 R |
| 5,900,545 | A | * | 5/1999 | Sacks et al. | 73/152.52 |
| 6,055,213 | A | * | 4/2000 | Rubbo et al. | 367/82 |
| 6,209,391 | B1 | * | 4/2001 | Dallas | 73/152.46 |

* cited by examiner

*Primary Examiner*—Daniel S. Larkin
*Assistant Examiner*—David J. Wiggins
(74) *Attorney, Agent, or Firm*—Trop, Pruner & Hu PC; Jeffrey Griffin; Brigitte Jeffery

(57) ABSTRACT

A hydraulic strain sensor for use with a downhole tool includes a housing having two chambers with a pressure differential between the two chambers. A mandrel is disposed in the housing. The mandrel is adapted to be coupled to the tool such that the weight of the tool is supported by the pressure differential between the two chambers. A pressure-responsive sensor in communication with the one of the chambers is provided to sense pressure changes in the chamber as the tool is accelerated or decelerated and to generate signals representative of the pressure changes.

51 Claims, 2 Drawing Sheets

HYDRAULIC STRAIN SENSOR

This application is a continuation and claims the benefit under 35 U.S.C. §120 to U.S. patent application Ser. No. 09/663,372, filed on Sep. 12, 2000, now U.S. Pat. No. 6,389,890 issued on May 21, 2002, which is a continuation of U.S. patent application Ser. No. 09/267,498, filed on Mar. 12, 1999, which became abandoned on Oct. 27, 2000.

BACKGROUND OF THE INVENTION

1. Technical Field

The invention relates generally to electrical downhole tools which are employed for various downhole oil-field applications, e.g., firing shaped charges through a casing and setting a packer in a wellbore. More particularly, the invention relates to a pressure-actuated downhole tool and a method and an apparatus for generating pressure signals which may be interpreted as command signals for actuating the downhole tool.

2. Background Art

Electrical downhole tools which are used to perform one or more operations in a wellbore may receive power and command signals through conductive logging cables which run from the surface to the downhole tools. Alternatively, the downhole tool may be powered by batteries, and commands may be preprogrammed into the tool and executed in a predetermined order over a fixed time interval, or command signals may be sent to the tool by manipulating the pressure exerted on the tool. The downhole pressure exerted on the tool is recorded using a pressure gage, and downhole electronics and software interpret the pressure signals from the pressure gage as executable commands. Typically, the downhole pressure exerted on the tool is manipulated by surface wellhead controls or by moving the tool over set vertical distances and at specified speeds in a column of fluid. However, generating pressure signals using these typical approaches can be difficult, take excessively long periods of time to produce, or require too much or unavailable equipment. Thus, it would be desirable to have a means of quickly and efficiently generating pressure signals.

SUMMARY OF THE INVENTION

In general, in one aspect, a hydraulic strain sensor for use with a downhole tool comprises a housing having two chambers with a pressure differential between the two chambers. A mandrel disposed in the housing is adapted to be coupled to the tool such that the weight of the tool is supported by the pressure differential between the two chambers. A pressure-responsive member in communication with one of the chambers is arranged to sense pressure changes in the one of the chambers as the tool is accelerated or decelerated and to generate signals representative of the pressure changes.

Other aspects and advantages of the invention will be apparent from the following description and the appended claims.

DETAILED DESCRIPTION

Figure 1:
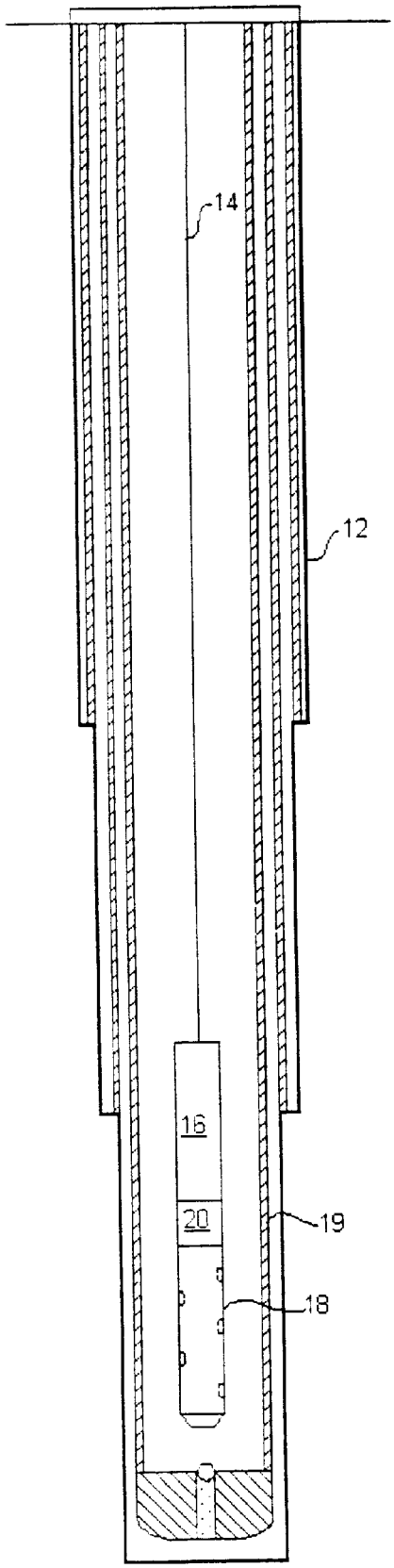
FIG. 1 is a schematic illustration of a downhole assembly for use in performing a downhole operation in a wellbore.

Referring to the drawings wherein like characters are used for like parts throughout the several views, FIG. 1 depicts a downhole assembly 10 which is suspended in a wellbore 12 on the end of a conveyance device 14. The conveyance device 14 may be a slickline, wireline, coiled tubing, or drill pipe. Although running the downhole assembly into the wellbore on a slickline or wireline is considerably faster and more economical than running on a coiled tubing or drill pipe. The downhole assembly 10 includes a hydraulic strain sensor 16 and a downhole tool 18 which may be operated to perform one or more downhole operations in response to pressure signals generated by the hydraulic strain sensor 16. For example, the downhole tool 18 may be a perforating gun which may be operated to fire shaped charges through a casing 19 in the wellbore 12.

The hydraulic strain sensor 16 includes a sealed chamber (not shown) which experiences pressure changes when the downhole tool 18 is accelerated or decelerated and a pressure-responsive sensor, e.g., a pressure transducer (not shown), which detects the pressure changes and converts them to electrical signals. The hydraulic strain sensor 16 communicates with the downhole tool 18 through an electronics cartridge 20. The electronics cartridge 20 includes electronic circuitry, e.g., microprocessors (not shown), which interprets the electrical signals generated by the pressure transducer as commands for operating the downhole tool 18. The electronics cartridge 20 may also include an electrical power source, e.g., a battery pack (not shown), which supplies power to the electrical components in the downhole assembly 10. Power may also be supplied to the downhole assembly 10 from the surface, e.g., through a wireline, or from a downhole autonomous power source.

Figure 2:
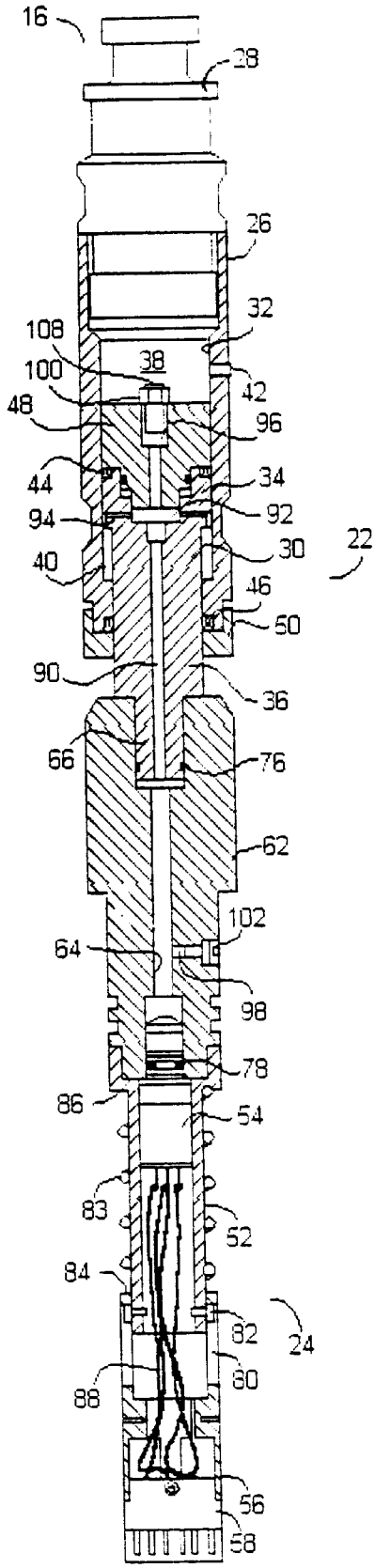
FIG. 2 is a detailed view of the hydraulic strain sensor shown in FIG. 1.

Referring to FIG. 2, the hydraulic strain sensor 16 comprises a hydraulic power section 22 and a sensor section 24. The hydraulic power section 22 includes a cylinder 26. A fishing neck 28 is mounted at the upper end of the cylinder 26 and adapted to be coupled to the conveyance device 14 (shown in FIG. 1) so that the hydraulic strain sensor 16 can be lowered into and retrieved from the wellbore on the conveyance device. With the fishing neck 28 coupled to the conveyance device 14, the hydraulic strain sensor 16 and other attached components can be accelerated or decelerated by jerking the conveyance device. The fishing neck 28 may also be coupled to other tools. For example, if the conveyance device 14 is inadvertently disconnected from the fishing neck 28 so that the hydraulic strain sensor 16 drops to the bottom of the wellbore, a fishing tool, e.g., an overshot, may be lowered into the wellbore to engage the fishing neck 28 and retrieve the hydraulic strain sensor 16. The fishing neck 28 may be provided with magnetic markers (not shown) which allow it to be easily located downhole.

A mandrel 30 is disposed in and axially movable within a bore 32 in the cylinder 26. The mandrel 30 has a piston portion 34 and a shaft portion 36. An upper chamber 38 is defined above the piston portion 34, and a lower chamber 40 is defined below the piston portion 34 and around the shaft portion 36. The upper chamber 38 is exposed to the pressure outside the cylinder 26 through a port 42 in the cylinder 26. A sliding seal 44 between the piston portion 34 and the cylinder 26 isolates the upper chamber 38 from the lower chamber 40, and a sliding seal 46 between the shaft portion 34 and the cylinder 26 isolates the lower chamber 40 from the exterior of the cylinder 26. The sliding seal 44 is retained on the piston portion 34 by a seal retaining plug 48, and the sliding seal 46 is secured to a lower end of the cylinder 26 by a seal retaining ring 50.

The sensor section 24 comprises a first sleeve 52 which encloses and supports a pressure transducer 54 and a second sleeve 56 which includes an electrical connector 58. The first sleeve 52 is attached to the lower end of a connecting body 62 with a portion of the pressure transducer 54 protruding into a bore 64 in the connecting body 62. An end 66 of the shaft portion 36 extends out of the cylinder 26 into the bore 64 in the connecting body 62. The end 66 of the shaft portion 26 is secured to the connecting body 62 so as to allow the connecting body 62 to move with the mandrel 30. Static seals, e.g., o-ring seals 76 and 78, are arranged between the connecting body 62 and the shaft portion 36 and pressure transducer 54 to contain fluid within the bore 64.

The second sleeve 56 is mounted on the first sleeve 52 and includes slots 80 which are adapted to ride on projecting members 82 on the first sleeve 52. When the slots 80 ride on the projecting members 82, the hydraulic strain sensor 16 moves relative to the downhole tool 18 (shown in FIG. 1). A spring 82 connects and normally biases an upper end 84 of the second sleeve 56 to an outer shoulder 86 on the first sleeve 52. The electrical connector 58 on the second sleeve 52 is connected to the pressure transducer 54 by electrical wires 88. When the hydraulic strain sensor 16 is coupled to the electronics cartridge 20 (shown in FIG. 1), the electrical connector 58 forms a power and communications interface between the pressure transducer 54 and the electronic circuitry and electrical power source in the electronics cartridge.

The shaft portion 36 has a fluid channel 90 which is in communication with the bore 64 in the connecting body 62. The fluid channel 90 opens to a bore 92 in the piston portion 34, and the bore 92 in turn communicates with the lower chamber 40 through ports 94 in the piston portion 34. The bore 92 and ports 94 in the piston portion 34, the fluid channel 90 in the shaft portion 36, and the bore 64 in the connecting body 62 define a pressure path from the lower chamber 40 to the pressure transducer 54. The lower chamber 40 and the pressure path are filled with a pressure-transmitting medium, e.g., oil or other incompressible fluid, through fill ports 96 and 98 in the seal retaining plug 48 and the connecting body 62, respectively. By using both fill ports 96 and 98 to fill the lower chamber 40 and the pressure path, the volume of air trapped in the lower chamber and the pressure path can be minimized. Plugs 100 and 102 are provided in the fill ports 96 and 98 to contain fluid in the pressure path and the lower chamber 40.

When the hydraulic strain sensor 16 is coupled to the downhole tool 18, as illustrated in FIG. 1, the net force, $F_{net}$, resulting from the pressure differential across the piston portion 34 supports the weight of the downhole tool 18. The net force resulting from the pressure differential across the piston portion 34 can be expressed as:

$$F_{net}=(P_{lc}-P_{uc})\cdot A_{lc} \tag{1}$$

where $P_{lc}$ is the pressure in the lower chamber 40, $P_{uc}$ is the pressure in the upper chamber 38 or the wellbore pressure outside the cylinder 26, $A_{lc}$ is the cross-sectional area of the lower chamber 40.

The total force, $F_{total}$, that is applied to the piston portion 34 by the downhole tool 18 can be expressed as:

$$F_{total}=m_{tool}(g-a)+F_{drag} \tag{2}$$

where $m_{tool}$ is the mass of the downhole tool 18, g is the acceleration due to gravity, a is the acceleration of the downhole tool 18, and $F_{drag}$ is the drag force acting on the downhole tool 18. Drag force and acceleration are considered to be positive when acting in the same direction as gravity.

Assuming that the weight of the sensor section 24 and the weight of the connecting body 62 is negligibly small compared to the weight of the downhole tool 18, then the net force, $F_{net}$, resulting from the pressure differential across the piston portion 34 can be equated to the total force, $F_{total}$, applied to the piston portion 34 by the downhole tool 18, and the pressure, $P_{lc}$, in the lower chamber 40 can then be expressed as:

$$P_{lc}=\frac{1}{A_{lc}}[m_{tool}\cdot(g-a)+F_{drag}+P_{uc}\cdot A_{lc}] \tag{3}$$

From the expression above, it is clear that the pressure, $P_{lc}$, in the lower chamber 40 changes as the downhole tool 18 is accelerated or decelerated. These pressure changes are transmitted to the pressure transducer 54 through the fluid in the lower chamber 40 and the pressure path. The pressure transducer 54 responds to the pressure changes in the lower chamber 40 and converts them to electrical signals. For a given acceleration or deceleration, the size of a pressure change or pulse can be increased by reducing the cross-sectional area, $A_{lc}$, of the lower chamber 40.

In operation, the downhole assembly 10 is lowered into the wellbore 12 with the lower chamber 40 and pressure path filled with a pressure-transmitting medium. When the downhole assembly 10 is accelerated in the upward direction, the total force, $F_{total}$, which is applied to the piston portion 34 by the downhole tool 18 increases and results in a corresponding increase in the pressure, $P_{lc}$, in the lower chamber 40. When the downhole tool 18 is accelerated in the downward direction, the force, $F_{total}$, which is applied to the piston portion 34 by the downhole tool 18 decreases and results in a corresponding decrease in the pressure, $P_{lc}$, in the lower chamber 40. The downhole assembly 10 may also be decelerated in either the upward or downward direction to effect similar pressure changes in the lower chamber 40. The pressure changes in the lower chamber 40 are detected by the pressure transducer 54 as pressure pulses. Moving the downhole assembly 10 in prescribed patterns will produce pressure pulses which can be converted to electrical signals that can be interpreted by the electronics cartridge 20 in the downhole tool 18 as command signals.

If the downhole assembly 10 becomes stuck and jars are used to try and free the assembly, the pressure differential across the piston portion 34 can become very high. If the bottom-hole pressure, i.e., the wellbore pressure at the exterior of the downhole assembly 10, is close to the pressure rating of the downhole assembly 10, then the pressure transducer 54 can potentially be subjected to pressures that are well over its rated operating value. To prevent damage to the pressure transducer 54, the fill plug 100 may be provided with a rupture disc 108 which bursts when the pressure in the lower chamber 40 is above the pressure rating of the pressure transducer 54. When the rupture disc 108 bursts, fluid will drain out of the lower chamber 40 and the pressure path, through the fill port 96, and out of the cylinder 26. As the fluid drains out of the lower chamber 40 and the pressure path, the piston portion 34 will move to the lower end of the cylinder 26 until it reaches the end of travel, at which time the hydraulic strain sensor 16 becomes solid and the highest pressure the pressure transducer 54 will be subjected to is the bottom-hole pressure. Instead of using a rupture disc, a check valve or other pressure responsive member may also be arranged in the fill port 96 to allow fluid to drain out of the lower chamber 40 when necessary.

If the downhole assembly 10 becomes unstuck, commands can no longer be generated using acceleration or deceleration of the downhole assembly 10. However, traditional methods such as manipulation of surface wellhead controls or movement of the downhole assembly 10 over fixed vertical distances in a column of liquid can still be used. When traditional methods are used, the pressure transducer 54, which is now in communication with the wellbore, will detect changes in wellbore or bottom-hole pressure around the hydraulic strain sensor 16 and transmit signals that are representative of the pressure changes to the electronics cartridge 20. It should be noted that while the downhole assembly 10 is stuck, pressure signals can still be sent to the downhole tool 18 by alternately pulling and releasing on the conveyance device 14.

The invention is advantageous in that pressure signals can be generated by simply accelerating or decelerating the downhole tool. The pressure signals are generated at the downhole tool and received by the downhole tool in real-time. The invention can be used with traditional methods of pressure-signal transmission, i.e., manipulation of surface wellhead controls or movement of the downhole tool over fixed vertical distances in a column of liquid.

While the invention has been described with respect to a limited number of embodiments, those skilled in the art will appreciate numerous variations therefrom without departing from the spirit and scope of the invention.

What is claimed is:

1. A downhole assembly for use in a wellbore, comprising:

a housing having a chamber with a fluid disposed therein;

the housing adapted to be coupled to a downhole tool such that the weight of the tool is supported by the fluid in the chamber; and a pressure-responsive sensor in fluid communication with the fluid, the pressure-responsive sensor being arranged to sense pressure changes in the fluid when there is a change in external force applied to the housing.

2. The assembly of claim 1, wherein the operation of the tool is enabled after receipt by the pressure-responsive sensor of a pre-determined pattern of pressure changes.

3. The assembly of claim 1, further comprising:

the pressure-responsive sensor being arranged to generate signals representative of the pressure changes;

an electronics cartridge receiving the signals generated by the pressure-responsive sensor; and the electronics cartridge operating the tool upon receipt of a pre-determined signal pattern from the pressure-responsive sensor.

4. The assembly of claim 1, wherein:

the housing is deployed in the wellbore on a conveyance device; and the change in external force is generated by manipulating the conveyance device.

5. The assembly of claim 1, further comprising:

a mandrel slidably disposed in the housing; and the mandrel adapted to be coupled to the tool such that the weight of the tool is supported by the fluid in the chamber.

6. A method of generating signals for operating a downhole tool in a wellbore, comprising:

providing a housing having a chamber and a fluid pressure-responsive sensor in communication with the chamber;

providing a fluid within the chamber;

coupling the tool to the housing such that the weight of the tool is supported by the fluid in the chamber;

changing an external force applied to the housing to create fluid pressure changes in the chamber; and detecting the fluid pressure changes in the chamber using the pressure-responsive sensor.

7. The method of claim 6, further comprising operating the tool after the pressure-responsive sensor detects a pre-determined pattern of pressure changes.

8. The method of claim 6, further comprising:

transmitting signals representative of the pressure changes in the chamber to an electronics cartridge; and operating the tool upon receipt of a pre-determined signal pattern from the pressure-responsive sensor.

9. The method of claim 6, further comprising:

deploying the sensor and the tool on a conveyance device; and the changing an external force step comprises manipulating the conveyance device.

10. A downhole assembly for use in a wellbore, comprising:

a housing having a chamber with a fluid disposed therein;

a mandrel slidably disposed in the housing and adapted to be coupled to a downhole tool such that the mandrel may slide when there is a change in external force applied to the housing thereby changing the pressure in the chamber; and a pressure-responsive sensor in fluid communication with the chamber, the pressure-responsive sensor being arranged to sense pressure changes in the fluid when there is a change in external force applied to the housing.

11. The assembly of claim 10, wherein the operation of the tool is enabled after receipt by the pressure-responsive sensor of a pre-determined pattern of pressure changes.

12. The assembly of claim 10, further comprising:

the pressure-responsive sensor being arranged to generate signals representative of the pressure changes;

an electronics cartridge receiving the signals generated by the pressure-responsive sensor; and the electronics cartridge operating the tool upon receipt of a pre-determined signal pattern from the pressure-responsive sensor.

13. The assembly of claim 10, wherein:

the housing is deployed in the wellbore on a conveyance device; and the change in external force is generated by manipulating the conveyance device.

14. A method of generating signals for operating a downhole tool, comprising:

providing a housing with a chamber;

providing a fluid within the chamber;

changing an external force applied to the housing;

providing a mandrel slidably disposed in the housing and adapted to be coupled to a downhole tool such that the mandrel may slide when there is a change in external force applied to the housing thereby changing the pressure in the chamber;

providing a fluid pressure-responsive sensor in communication with the fluid in the chamber; and detecting the fluid pressure changes in the fluid using the pressure-responsive sensor.

15. The method of claim 14, further comprising operating the tool after the pressure-responsive sensor detects a pre-determined pattern of pressure changes.

16. The method of claim 14, further comprising:

transmitting signals representative of the pressure changes in the chamber to an electronics cartridge; and operating the tool upon receipt of a pre-determined signal pattern from the pressure-responsive sensor.

17. The method of claim 14, further comprising:

deploying the sensor and the tool on a conveyance device; and the changing an external force step comprises manipulating the conveyance device.

18. An assembly for use in a wellbore, comprising:

a strain sensor connected to a downhole tool;

the strain sensor adapted to detect a pressure change in a fluid inside the sensor to sense when there is a change in external force applied to the assembly; and the strain sensor adapted to enable the operation of the downhole tool upon sensing a predetermined pattern of changes in external force applied to the assembly.

19. The assembly of claim 18, wherein:

the strain sensor includes a chamber with the fluid disposed therein;

the strain sensor is adapted to sense pressure changes in the fluid caused by changes in external force applied to the assembly; and the strain sensor is adapted to enable the operation of the tool upon sensing a predetermined pattern of pressure changes in the fluid.

20. The assembly of claim 18, wherein:

the strain sensor is adapted to be coupled to a conveyance device so as to be lowered into the wellbore; and the changes in external force are generated by manipulating the conveyance device.

21. The assembly of claim 18, wherein:

the hydraulic strain sensor is adapted to convert the pattern of changes in external force applied to the assembly into electrical signals; and the operation of the downhole tool is enabled after the conversion of a pre-determined signal pattern.

22. A method of generating signals for operating a downhole tool, comprising:

providing a strain sensor connected to a downhole tool;

changing an external force applied to the strain sensor to change a pressure of fluid inside the sensor; and operating the tool upon sensing a pre-determined pressure pattern in the fluid.

23. The method of claim 22, wherein:

the strain sensor includes a chamber with the fluid disposed therein;

the sensing step comprises sensing pressure changes in the fluid caused by changes in external force applied to the strain sensor; and the operating step comprises operating the tool upon sensing a pre-determined pattern of pressure changes in the fluid.

24. The method of claim 22, wherein:

lowering the strain sensor and downhole tool on a conveyance device; and the changing an external force step comprises manipulating the conveyance device.

25. The method of claim 22, wherein the operating step comprises:

converting the pattern of changes in external force applied to the hydraulic strain sensor into electrical signals; and operating the tool upon conversion of a pre-determined signal pattern.

26. An assembly for use in a wellbore, comprising:

a strain sensor connected to a downhole tool;

the strain sensor adapted to generate at least one pressure pulse; and the downhole tool adapted to operate when the strain sensor generates a pre-determined pattern of pressure pulses.

27. The assembly of claim 26, wherein:

the strain sensor is adapted to convert the pressure pulses into electrical signals; and the operation of the downhole tool is enabled after the conversion of a pre-determined electrical signal pattern.

28. A method of generating signals for operating a downhole tool, comprising:

providing a strain sensor connected to a downhole tool;

generating at least one pressure pulse in the strain sensor; and operating the tool when the strain sensor generates a predetermined pattern of pressure pulses.

29. The method of claim 28, wherein the operating step comprises:

converting the pressure pulses into electrical signals; and operating the tool upon conversion of a pre-determined electrical signal pattern.

30. An assembly for use in a wellbore, comprising:

a hydraulic strain sensor connected to a downhole tool;

the hydraulic strain sensor adapted to sense changes in external force applied thereto; and the hydraulic strain sensor adapted to convert the changes in external force into a pattern of pressure signals.

31. The assembly of claim 30, wherein the hydraulic strain sensor is further adapted to convert the pattern of pressure signals into a pattern of electrical signals.

32. A method of generating signals in a wellbore, comprising:

providing a hydraulic strain sensor connected to a downhole tool in order to control operation of the downhole tool;

changing an external force applied to the hydraulic strain sensor; and converting the external force changes into a pattern of pressure signals.

33. The method of claim 32, further comprising converting the pattern of pressure signals into a pattern of electrical signals.

34. An assembly usable in a wellbore, comprising:

a downhole tool; and a strain sensor connected to the downhole tool to generate at least one pressure pulse indicative of acceleration or deceleration of the downhole tool, wherein the downhole tool is adapted to operate in response to said at least one pressure pulse.

35. The assembly of claim 34, wherein:

the strain sensor is adapted to convert said at least one pressure pulse into an electrical indication of the acceleration or deceleration of the tool.

36. A method comprising:

moving a downhole tool within a subterranean well;

in response to the movement of the downhole tool, generating at least one fluid pressure pulse in a contained fluid downhole indicative of the movement; and operating the tool in response to said at least one fluid pressure pulse.

37. The method of claim 36, comprising:

forming an electrical indication of said at least one fluid pressure pulse; and operating the tool in response to the electrical indication.

38. An assembly usable in a wellbore, comprising:

A downhole tool; and

A sensor connected to the downhole tool to generate an indication of acceleration or deceleration of the downhole tool; wherein the downhole tool is adapted to operate in response to the indication from the sensors and wherein the sensor comprises a strain sensor.

39. The assembly of claim 38, wherein the sensor is adapted to provide an electrical indication of the acceleration or deceleration of the tool.

40. The assembly of claim 38, wherein the downhole tool is connected to a slickline and the sensor indicates a force applied to the slickline.

41. An assembly usable in a wellbore, comprising:

A downhole tool; and

An accelerometer connected to the downhole tool to indicate acceleration or deceleration of the downhole tool; wherein the downhole tool is adapted to operate in response to the indication from the accelerometer, and wherein the accelerometer comprises a strain sensor.

42. The assembly of claim 41, wherein the accelerometer is adapted to provide an electrical indication of the acceleration or deceleration of the tool.

43. The assembly of claim 41, wherein the downhole tool is connected to a slickline and the accelerometer indicates a force applied to the slickline.

44. An assembly usable in a wellbore, comprising:

A downhole tool adapted to be supported by a slickline into the wellbore; and

A sensor adapted to indicate a force applied on the slickline from the surface of the well to the tool; wherein the downhole tool is adapted to operate in response to the indication from the sensor, and wherein the sensor comprises a strain sensor.

45. The method of claim 44, wherein the tool comprises a perforating gun.

46. The assembly of claim 44, wherein the sensor is adapted to provide an electrical indication of the acceleration or deceleration of the tool.

47. The assembly of claim 44, wherein the sensor comprises an accelerometer.

48. A method comprising:

moving a dowhhole tool within a subterranean well;

in response to the movement of the downhole tool, generating an indication of the movement; and in response to the indication of movement, operating the tool; and further comprising detecting an acceleration of the tool.

49. The method of claim 48, wherein the tool comprises a perforating gun.

50. The method of claim 48, wherein the moving comprises applying a force to a slickline connected to the downhole tool.

51. A method comprising:

moving a downhole tool within a subterranean well;

in response to the movement of the downhole tool, generating an indication of the movement; and in response to the indication of movements operating the tool; and further comprising detecting an deceleration of the tool.

* * * * *